United States Patent [19]

Denjean

[11] 4,114,862

[45] Sep. 19, 1978

[54] PROCESSES AND INSTALLATIONS FOR MELTING PIG-IRON IN A CUPOLA FURNACE

[75] Inventor: René Denjean, Pavillon-sous-Bois, France

[73] Assignee: Air Industrie, France

[21] Appl. No.: 799,284

[22] Filed: May 23, 1977

[30] Foreign Application Priority Data

May 26, 1976 [FR] France ..... 76 16075

[51] Int. Cl.[2] ..... F27B 1/22

[52] U.S. Cl. ..... 266/44; 60/39.12; 266/155; 266/219; 266/166

[58] Field of Search ..... 60/39.18 R, 39.18 B, 60/39.12; 266/44, 197, 155, 219, 166

[56] References Cited

U.S. PATENT DOCUMENTS 3,737,153 6/1973 Steffora et al. ..... 266/240

FOREIGN PATENT DOCUMENTS 350,826 9/1972 U.S.S.R. ..... 266/155

OTHER PUBLICATIONS

American Foundryman's Society, The Cupola & It's Operation, 3rd Edition, 1956, Des Plains, Ill. pp. 24–25.

*Primary Examiner*—Roy Lake
*Assistant Examiner*—Paul A. Bell
*Attorney, Agent, or Firm*—Kirkland & Ellis

[57] ABSTRACT

The invention relates to an installation for melting pig-iron comprising a cupola furnace, a combustion chamber burning the waste gases leaving this cupola furnace. This installation comprises furthermore a heat exchanger between the flue gases leaving this combustion chamber and a thermodynamic fluid driving at least one rotary machine coupled to at least one electric generator, a superheating furnace for the pig-iron in the liquid state disposed between the cupola furnace and a casting station. This superheating furnace is supplied by said electric generator, and switching means for diverting a part of the electric energy of the electric generator towards user means, which permits, by simply adjusting the proportion of coke in the charge of the cupola furnace, to regulate the superheating temperature of the pig-iron leaving the cupola furnace to a value such that there is obtained a better overall economy derived, on the one hand, from the economy in the consumption of coke and, on the other hand, from the production of electric energy for other user means.

5 Claims, 2 Drawing Figures

PROCESSES AND INSTALLATIONS FOR MELTING PIG-IRON IN A CUPOLA FURNACE

The invention relates to processes and installations for melting pig-iron in a cupola furnace.

In most processes and installations known up to the present time, the source of energy used in the cupola furnace is the combustion of the coke which provides the pre-heating of the charge of the cupola furnace (steel, iron, return pig-iron, limestone flux, coke etc . . . ) and the superheating of the pig-iron in the liquid state for casting operations.

Now a large part of the energy produced in the cupola furnace is to be found in the gases leaving the furnace (waste gases), this part representing about 40%.

On the other hand, it is relatively easy to recover a fraction of this part; it is thus that, taking into account the carbon oxide content of the waste gases, these waste gases are directed into a combustion chamber delivering high temperature flue gases which, through heat exchange means, permit the reheating of the air admitted at the base of the cupola furnace (hot blast).

Thus, economies can be made in the consumption of coke but these economies are limited by the need to superheat the pig-iron in the liquid state for casting operations.

The invention has as its object to maintain superheating of the pig-iron in the liquid state which is compatible with casting operations while still being able, on the one hand, to achieve economies in the consumption of coke and, on the other hand, to generate electric energy available for other uses.

The process of the invention consists in recovering a part of the energy of the flue gases coming from the combustion of the waste gases in a thermodynamic circuit, the fluid of which drives at least one rotary machine coupled to at least one electric generator which, with a part of the energy it delivers, supplies a furnace for superheating the pig-iron in the liquid state disposed between the cupola furnace and a casting station, which permits, by simply adjusting the proportion of coke in the charge of the furnace, to regulate the superheating temperature of the pig-iron leaving the cupola furnace at a value between the melting temperature of the pig-iron and a temperature compatible with casting operations, the complement of the superheating being supplied by the superheating furnace by regulating the supply of electric energy.

Thus, economies are achieved in the consumption of coke whilst still maintaining superheating compatible with casting operations and there is available surplus electric energy from said electric generator.

The installation of the invention comprises a cupola furnace, a combustion chamber burning the waste gases coming from this cupola furnace and it is characterised by the fact that it comprises furthermore a heat exchanger between the flue gases coming from this combustion chamber and a thermodynamic fluid driving at least one rotary machine coupled to at least one electric generator, a superheating furnace for the pig-iron in the liquid state disposed between the cupola furnace and a casting station, said superheating furnace being supplied with power by said electric generator and switching means for diverting a part of the electric energy of the electric generator to user means, which permits, by simply adjusting the proportion of coke in the charge of the cupola furnace, to regulate the superheating temperature of the pig-iron coming from the cupola furnace at a value such that a better overall economy is obtained, derived on the one hand, from the economy in the consumption of coke and, on the other hand, from the production of electric energy for other user means.

In other words, we can then with the invention fix the rates of superheating the pig-iron in the liquid state obtained respectively in the cupola furnace by combustion of the coke and in the superheating furnace by electric energy which is dissipated therein; the operation of the unit can then be adapted to the optimum conditions taking into account the price of coke and of kWh.

Thus, if the conditions of the market show relatively low prices for coke, it will be advantageous to have a high rate of superheating in the cupola furnace and a low rate of superheating in the electric furnace, the user means having then at their disposal a large part of the electric energy supplied by the electric generator.

On the contrary, if the conditions of the market show a relatively high price for coke, it will be advantageous to have a low rate of superheating in the cupola furnace and a high rate of superheating in the electric furnace, the user means still having available a part, small but not inconsiderable, of the electric energy supplied by the electric generator.

It is even possible, in the same day, to modify the respective rates of superheating in consideration of the variation in costs of the electric energy bought according to whether the installation operates at off-peak times or at peak times. A high rate of superheating will be advantageous in the cupola furnace during peak times so as to be able to have available a considerable part of the electric energy supplied by the electric generator. On the contrary, a low rate of superheating will be advantageous in the cupola furnace during off-peak times so as to achieve the maximum economy of coke; the electric energy available at the output of the electric generator, after supplying the superheating furnace, being then more reduced and compensated for by the purchase of cheap outside electric energy.

The invention permits, for a given pig-iron manufacture, an extension of of the range of choice of coke to be used. In fact, a coke of medium quality, highly reactive, giving a high percentage of carbon monoxide, consequently having an indifferent combustion efficiency, can be advantageously used since a not inconsiderable part of the heat energy not used (latent heat of carbon monoxide) is transformed, according to the invention, into electric energy directly usable by the melting station.

The invention consists, apart from the arrangements which have just been mentioned, certain other arrangements which are used preferably at the same time and which will be more explicitly described hereafter.

The invention will, in any case, be better understood with the help of the complement of description which follows as well as with the accompanying drawings, which complement and drawings relate to preferred embodiments of the invention which are in no way restrictive.

Figure 1:
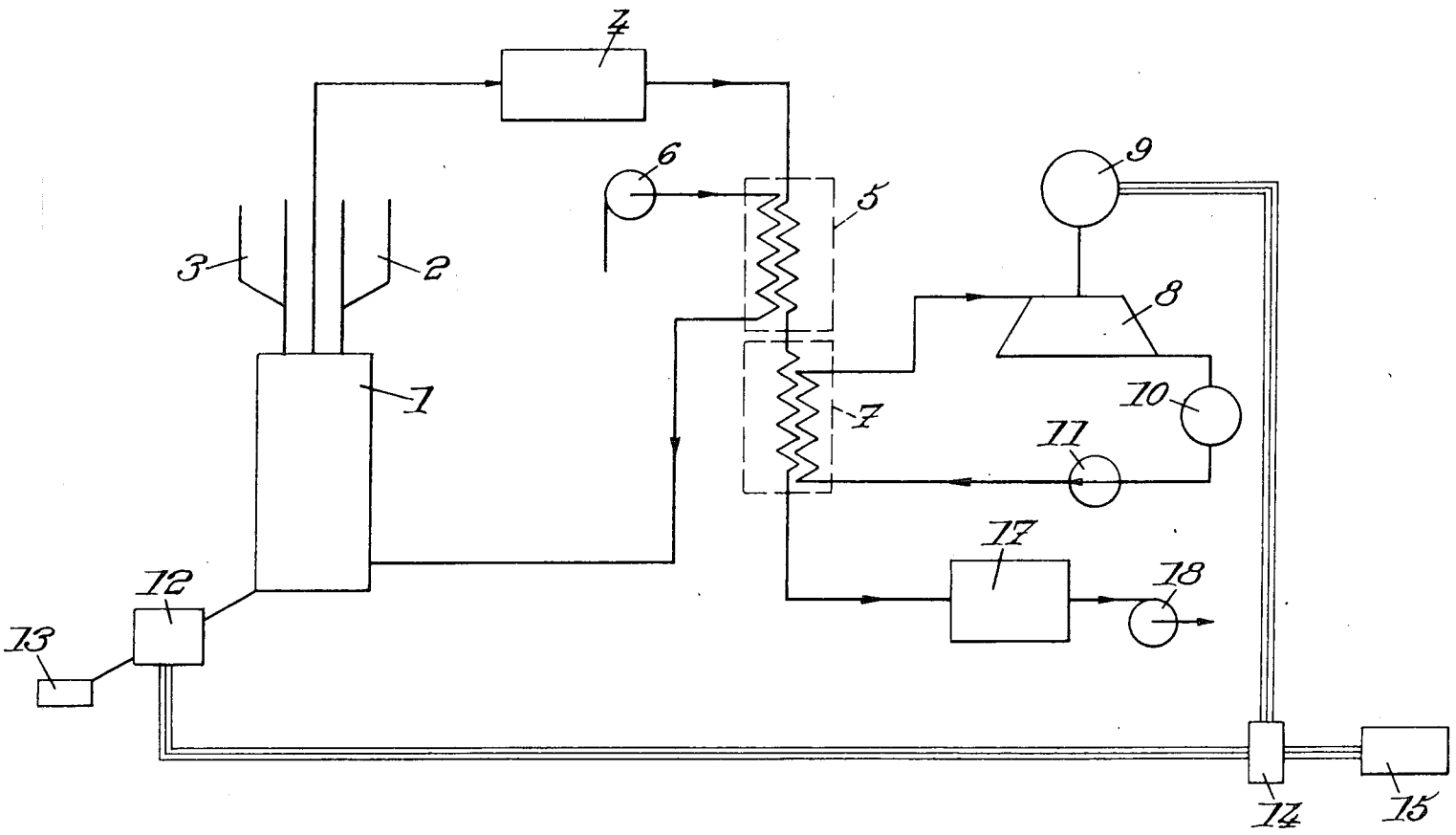
FIG. 1 is a schematic view showing a first embodiment of the invention.
Figure 2:
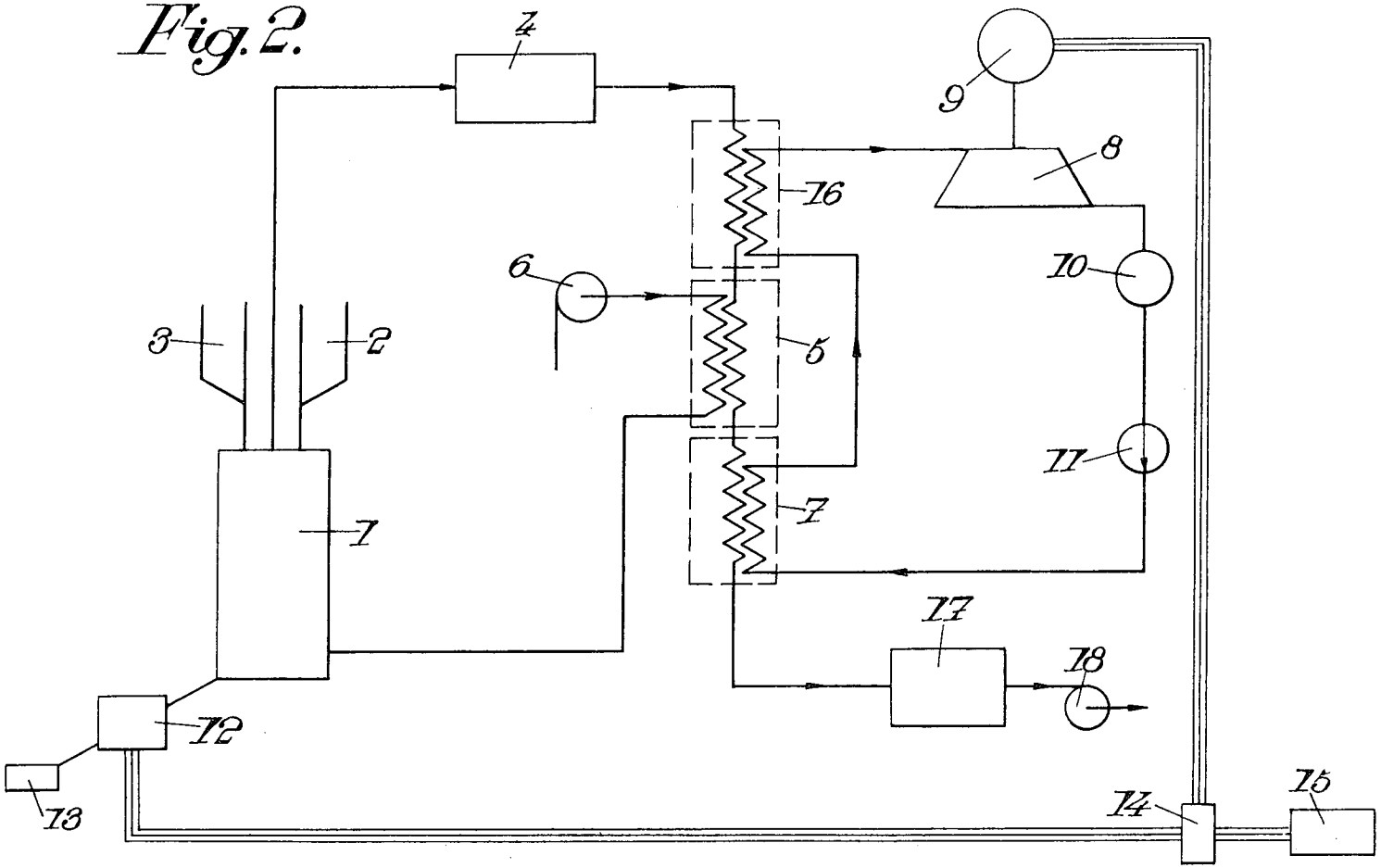
FIG. 2 is a schematic view showing another embodiment of the invention.

The installation shown in FIGS. 1 and 2 comprises a cupola furnace 1 whose charge is provided by coke supply means 2 and steel, iron, pig-iron, limestone flux etc. supply means 3.

A combustion chamber 4 receives the waste gases leaving the cupola furnace 1 and delivers flue gases whose temperature is generally brought down to 800° – 900° by recycling cold fumes or by dilution with ambient air.

A first heat exchanger 5 is provided between these flue gases and the air which is admitted at the base of furnace 1 (hot blast); this air is circulated with a fan 6.

According to the embodiment illustrated in FIG. 1, a second heat exchanger 7 is provided, down stream of the first heat exchanger 5, between the flue gases and a thermodynamic fluid driving a turbine 8 coupled to an electric generator 9; a condenser 10 and a circulating pump 11 are disposed, in a conventional way, in the circuit of this thermodynamic fluid.

This electric generator 9 supplies a superheating furnace 12 disposed between cupola furnace 1 and a casting station 13, switching means 14 being provided for diverting a part of the electric energy of electric generator 9 towards user means 15.

According to the embodiment illustrated in FIG. 2, a second heat exchanger 7 is provided, down stream of the first heat exchanger 5, between the flue gases and a thermodynamic fluid driving turbine 8 coupled to generator 9, and a third heat exchanger 16 for superheating said thermodynamic fluid is provided upstream of the first heat exchanger 5. This thermodynamic circuit comprises also condenser 10 and circulating pump 11.

As in the embodiment shown in FIG. 1, this electric generator 9 supplies a superheating furnace 12 disposed between cupola furnace 1 and a casting station 13, switching means 14 being provided to divert a part of the electric energy of the electric generator 9 towards user means 15.

After passing through heat exchangers 5 and 7 (FIG. 1) and heat exchangers 16, 5 and 7 (FIG. 2) the flue gases are directed into a filtering device 17 from which they are extracted by a fan 18 to be discharged into the atmosphere.

As an example, in an installation for melting pig-iron in a hot blast cupola furnace able to produce 25t/h of pig-iron (from a charge comprising 60% steel) we can reckon on about 110 kg of coke to obtain 1 ton of superheated pig-iron in the liquid state at a temperature of 1500°, satisfactory for casting operations.

The same installation, in which the pig-iron in the liquid state in the cupola furnace is maintained at a temperature above its melting temperature but below the 1500° of the preceding case, would consume 99 kg of coke per ton of pig-iron.

In this installation provided with the improvements of the invention, it would be possible to obtain at the electric generator a power of 1600 kW which would be used in the following way, 600 kW in the electric superheating furnace and 1000 kW in user means.

Thus it can be seen that, on the one hand, an economy in the consumption of coke of about 10% has been obtained and, on the other hand, there are 1000 kW available for user means.

It is evident, and as it follows from what has gone before, the invention is in no way limited to those of its modes of application and embodiments which have been more particularly considered; it covers on the contrary all variations.

I claim:

1. In a process for melting pig-iron for subsequent casting in an installation comprising a cupola furnace the improvement comprising:

subjecting the waste gases from said cupola furnace to combustion to form flue gases;

recovering at least a portion of the heat from said flue gases in a thermodynamic circuit;

utilizing said thermodynamic circuit to generate electricity by means of at least one rotary machine coupled to at least one electric generator;

adjusting the proportion of coke in the charge to the cupola furnace to regulate the superheating temperature of the pig-iron leaving the cupola furnace at a valve between the melting temperature of the pig-iron and the temperature compatible with said casting; and supplying a portion of said electricity to a superheating furnace between said cupola furnace and the casting operation to complete heating said pig-iron leaving the cupola furnace to the temperature compatible with the casting operation.

2. An installation for melting pig-iron for subsequent casting comprising: a cupola furnace; a combustion chamber in which the waste gases leaving the cupola furnace are burned to form flue gases; at least one heat exchanger wherein a portion of the heat in the flue gases from the combustion chamber is transferred to a thermodynamic fluid; at least one rotary machine coupled to at least one electric generator whereby the thermodynamic fluid is utilized to generate electricity;

a superheating furnace for the pig-iron in the liquid state disposed between the cupola furnace and a casting station, said superheating furnace being operated by at least a portion of the electricity from said generator;

adjusting means to control the proportion of coke in the charge to the cupola furnace to control the temperature of the pig-iron leaving the cupola furnace at a value between the melting temperature of the pig-iron and the temperature of the pig-iron compatible with said casting; and electrical switching means for controlling the proportion of the electricity from said generator to be supplied to said superheating furnace to complete heating the pig-iron from the cupola furnace to a temperature compatible with the casting;

said adjusting means and said electrical switching means being capable of utilization to obtain overall economy in the installation by controlling the consumption of coke and the production of electricity from the waste gases.

3. The installation for melting pig-iron according to claim 2 and further comprising a first heat exchanger wherein a portion of said heat in the flue gases is transferred to the air which is supplied to the base of the cupola furnace.

4. The installation for melting pig-iron according to claim 8 wherein said heat exchanger for heating said thermodynamic fluid is located downstream from said first heat exchanger based on the flow of flue gases.

5. The installation for melting pig-iron according to claim 4 and further comprising a heat exchange for superheating said thermodynamic fluid with said fluid gases located upstream of said first heat exchanger based on the flow of flue gases.

* * * * *

UNITED STATES PATENT AND TRADEMARK OFFICE

CERTIFICATE OF CORRECTION

PATENT NO. : 4,114,862

DATED : September 19, 1978

INVENTOR(S) : Rene Denjean

It is certified that error appears in the above-identified patent and that said Letters Patent are hereby corrected as shown below:

Column 4, line 59, "8" should read --3--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*